United States Patent [19]

Kokubu

[11] 4,227,822

[45] Oct. 14, 1980

[54] COMPOSITE WRITING INSTRUMENT

[75] Inventor: Teruo Kokubu, Hoyashi, Japan

[73] Assignee: Zebra Co., Ltd., Tokyo, Japan

[21] Appl. No.: 931,279

[22] Filed: Aug. 4, 1978

[30] Foreign Application Priority Data

Aug. 5, 1977 [JP] Japan ..... 52-104266[U]

[51] Int. Cl.[2] ..... B43K 27/02; B43K 24/16

[52] U.S. Cl. ..... 401/17; 401/19; 401/33; 401/65

[58] Field of Search ..... 401/16, 20, 29, 30, 401/17, 19, 32, 33, 49, 65

[56] References Cited

U.S. PATENT DOCUMENTS

| | | | |
|---|---|---|---|
| 1,534,629 | 4/1925 | Anshen | 401/17 |
| 1,567,910 | 12/1925 | Brynda et al. | 401/33 |
| 1,827,311 | 10/1931 | Felipe | 401/17 |
| 2,176,124 | 10/1939 | Dürrler | 401/33 |
| 2,264,463 | 12/1941 | Tomatsu | 401/30 |
| 2,826,173 | 3/1958 | Gossweiler et al. | 401/33 |
| 3,266,465 | 8/1966 | Ganz | 401/33 |
| 3,700,340 | 10/1972 | Terasaki | 401/33 |
| 4,148,591 | 4/1979 | Tomura | 401/17 |

FOREIGN PATENT DOCUMENTS

| | | | |
|---|---|---|---|
| 2746409 | 4/1978 | Fed. Rep. of Germany | 401/30 |

*Primary Examiner*—William Pieprz

*Attorney, Agent, or Firm*—Wenderoth, Lind & Ponack

[57] ABSTRACT

A composite writing instrument, in which a mechanical pencil unit of the type from which lead is ejected and a ball point pen unit are mutually diametrically opposed and held together within a lower tubular casing. A cap is provided accommodating a mechanism for engaging these units to shift them alternately in the axial direction when the cap is rotated around the axis, whereby the units are alternately advanced through a mouth of the writing tip of the lower tubular casing to a writing position or retracted therethrough to a storage position within said lower tubular casing. The mechanical pencil unit is so constructed that the cap is shiftable within certain limits in the axial direction relative to the lower tubular casing when the mechanical pencil unit is in the writing position, whereby the lead of the pencil unit is fed, whereas the cap is nonshiftably locked relative to the lower tubular casing when the ball point pen unit is in the writing position.

2 Claims, 17 Drawing Figures

Fig. 5
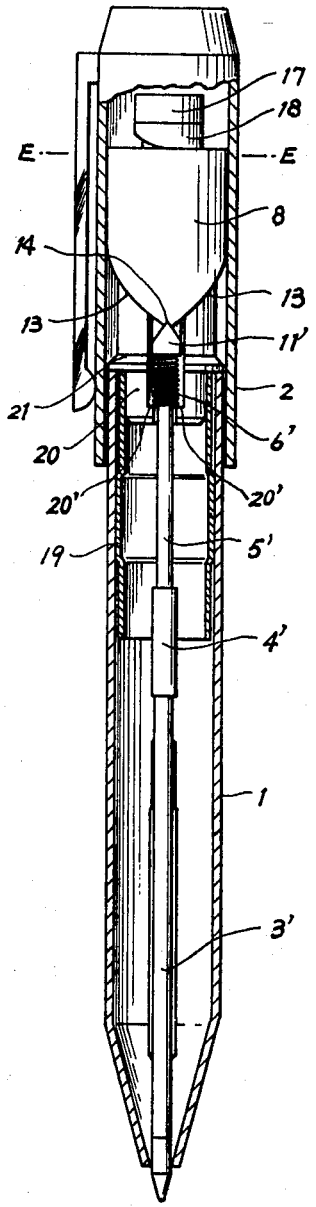
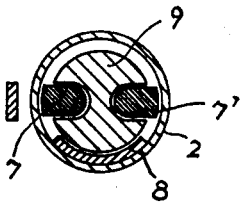
FIG. 6A
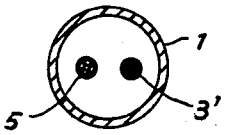
FIG. 6B
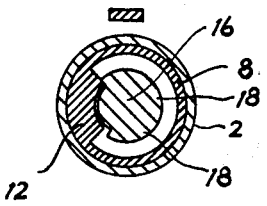
FIG. 6C
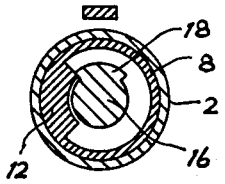
FIG. 6D
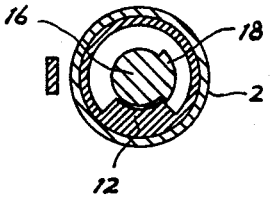
FIG. 6E

COMPOSITE WRITING INSTRUMENT

BACKGROUND OF THE INVENTION

There is well known a writing instrument in which two-color ball point pen units are held in a tubular casing, and a cap holding a cam mechanism for engaging these units is rotated reciprocatingly through a certain angle around the axis of the casing, whereby said units are alternately shifted into a writing position or a storage position. However, in such a mechanism of the writing instrument, the cap can not be shifted in the axial direction, so that if one ball point pen unit is replaced by a mechanical pencil unit, the feed of lead by an axial shifting operation of the pencil unit cannot be effected.

SUMMARY OF THE INVENTION

The present invention has as its object the provision of a composite writing instrument, wherein an upper tubular casing or a cap is rotated around the axis of the casing to shift a mechanical pencil unit and a ball point pen unit alternately into a writing position, and when the mechanical pencil unit is shifted into the writing position, the cap is shiftable within certain limits in the axial direction relative to a lower tubular casing, whereby the feeding operation of lead of the mechanical pencil unit is effected, and when the ball point pen unit is shifted into the writing position, the axial shifting movement of the cap is blocked, so that with a simple structure, alternate shifting of both the writing units into the writing positions is smoothly and surely effected, and yet the mechanical pencil unit can effect feeding of lead by shifting of the cap in the axial direction.

To this end the invention provides a composite writing instrument having a mechanical pencil unit provided with a lead ejecting mechanism for feeding the lead and a ball point pen unit, both units being held in a common tubular casing. More particularly, this invention is characterized by a lead ejecting type mechanical pencil unit (hereinafter, simply called a mechanical pencil unit which) and a ball point pen unit are held within a lower tubular casing, an upper tubular casing or a cap, which holds a mechanism rotatable around the axis of said tubular casing and engaged with both of said writing units to shift them alternately in the axial direction, which casing or cap is rotated around the axis, for alternately advancing said writing units through a mouth of the writing tip of the lower tubular casing to a writing position or retracting them to a storage position within said lower tubular casing. When said mechanical pencil unit is in the writing position, said cap is shiftable relative to said tubular casing in the axial direction within certain limits, whereby the lead of said mechanical pencil unit is fed, and when said ball point pen unit is in the writing position, said cap is non-shiftably locked relative to said lower tubular casing.

BRIEF DESCRIPTION OF THE DRAWINGS

Other objects and aspects of this invention will become apparent from the following description and the accompanying drawings in which:

FIG. 5 is a broken away sectional front view of the state in which the ball point pen unit is in a writing position, seen from the side of a curved casing.

FIG. 6(*a*) is a sectional view taken along line A—A of FIG. 1, FIG. 6(*b*) is a sectional view taken along line B—B of FIG. 1, FIG. 6(*c*) is a sectional view taken along line C—C of FIG. 3, FIG. 6(*d*) is a sectional view taken along line D—D of FIG. 4 and FIG. 6 (*e*) is a sectional view taken along line E—E of FIG. 5.

DESCRIPTION OF THE PREFERRED EMBODIMENT

Figure 1:
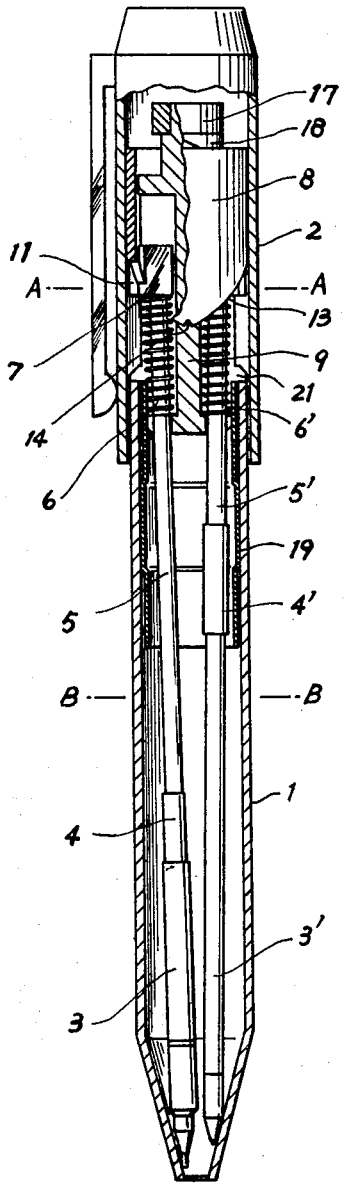
FIG. 1 is a partly broken away sectional front view, showing the structure of the interior a writing instrument according to this invention with a ball point pen unit and a mechanical pencil unit being in a storage position.
Figure 2:
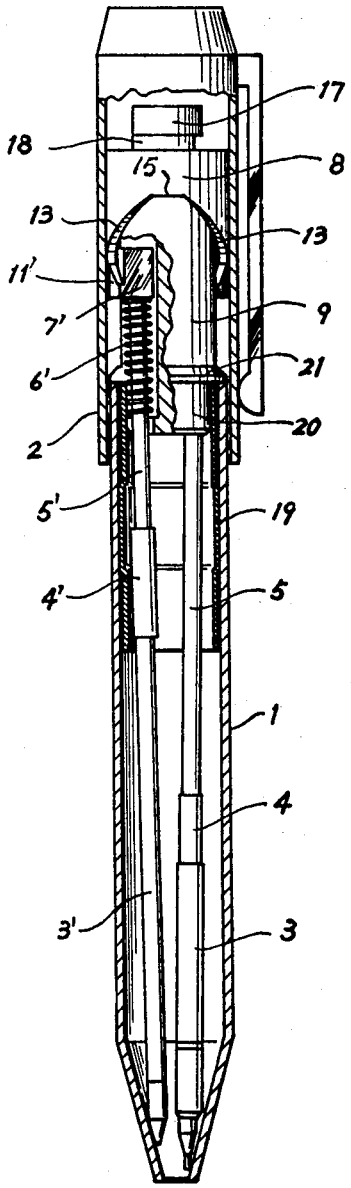
FIG. 2 is a partly broken away sectional rear view of the instrument of FIG. 1.

In the drawings, the instrument comprises a lower tubular casing 1, within which a mechanical pencil unit 3 and a ball point pen unit 3' are mutually diametrically opposed and held together. The upper ends of these units 3 and 3' are connected to rods 5 and 5' through connecting sleeves 4 and 4', and on the upper ends of said rods 5 and 5', sliders 7 and 7' are provided.

In an upper cavity of the lower tubular casing, a coupling sleeve 19 is tightly inserted, within which a lower tube 20 of a guide sleeve 9 is tightly inserted. An annular projection 21 on the guide sleeve 9 abuts the upper end face of the lower tubular casing 1 to serve as a stop therefor. Thus, the lower tubular casing 1 and the guide sleeve 9 are solidly connected together.

The guide sleeve is cylindrical and is provided with guide grooves 10 and 10' (FIG. 10) which are spaced by 180° around the guide sleeve and opposed each other to guide the sliders 7 and 7' in the axial direction. The sliders 7 and 7' provided on the tips of the rods 5 and 5' are resiliently held in the guide grooves 10 and 10' by coiled springs 6 and 6' and guided in the axial direction by said guide grooves 10 and 10'. The lower portions of the guide grooves 10 and 10' have a smaller width to form a stepped portion 20' on which the lower ends of said coiled springs 6 and 6' are supported.

Figure 9:
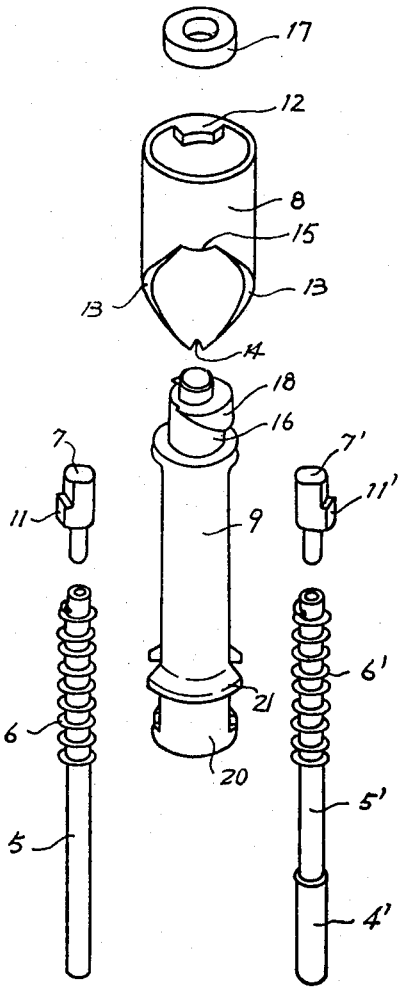
FIG. 9 is an exploded view of the cam mechanism.

On the top portion of the guide sleeve 9 is formed a shaft head 16 having a tip shaft 16' thereon and on said shaft head 16 is formed a fixed cam 18 having a form shown in the developed view of FIG. 9 and FIG. 10 extending around the shaft and formed in part by the lower face of a fixing ring 17 secured to the tip shaft 16' of the shaft head 16. As seen from FIG. 10, the cam 18 comprises a stop 18*a*, a downwardly facing flat face 18*b*, a downwardly facing slanting face 18c and a stop 18d (provided on the stopper 18a, seen on the left end of the figure) in succession starting from the right side of the figures, and between the flat face 18b and the top face of the guide sleeve 9, there is a clearance t, into which a sector stop 12 may be inserted, as will be described hereinafter, and between the end of the slanting face 18c and the end face of the stop 18d, there is formed a portion 17a, which corresponds to the lower face of the fixing ring 17.

As shown in FIG. 1 to FIG. 4 and FIG. 9, the guide sleeve 9 is slidably inserted within a rotable cylindrical cam casing 8.

On the lower end of the curved casing 8 is a sliding cam face, as is shown FIG. 9 and FIG. 10 in particular. As seen from the figures, the sliding cam face has a flat portion 15 at the top and slanting sliding faces 13 and 13 which extend downwardly from and are symmetrical with respect to said flat portion 15 and having a notched engaging portion 14 at the lower junction of said slanting faces 13 and 13. The notched engaging portion 14 is so formed that it is engaged with the tips of upwardly pointed engaging portions 11 and 11' which are provided on the surfaces of said sliders 7 and 7'. The slanting faces of these pointed engaging portions 11 and 11' engage with the sliding cam face and cause the sliders 7 and 7' to slide along guide grooves 10 and 10' during the rotation of the casing 8.

On the other hand, the sector stop 12 is provided on the inner periphery of the upper end of the casing 8 and projects into the casing 8, as seen in FIGS. 6c–6e, FIG. 7 and FIG. 9. This stop 12 engages with the cam 18 which is formed on peripheral surface of the shaft head 16, as will be described hereinafter.

Figure 3:
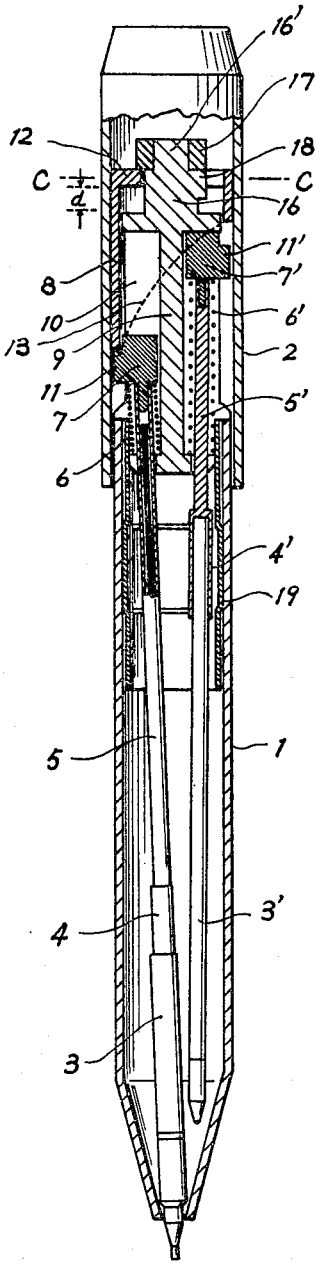
FIG. 3 is a partly broken away sectional front view, showing the state in which the mechanical pencil unit has been moved to a writing position by the rotation of a cap.
Figure 4:
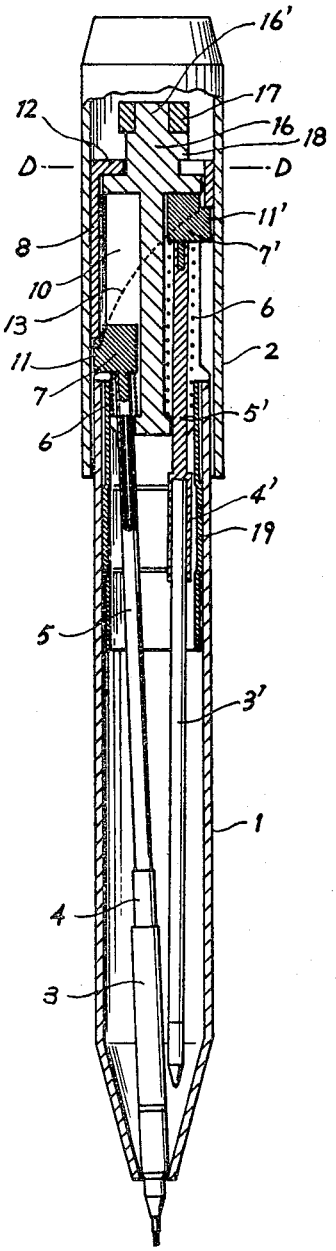
FIG. 4 is a partly broken away sectional front view, showing the state in which the cap is shifted downwardly in the axial direction for the purpose of feeding the lead of the mechanical pencil unit which is in the writing position of FIG. 3.
Figure 7:
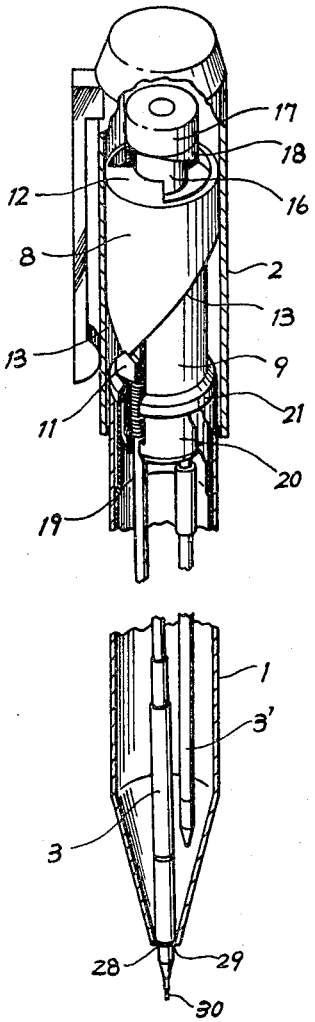
FIG. 7 is a broken and partly broken away perspective view, showing a cam mechanism.

A fixing ring 17 is fitted on the shaft head 16 after the casing 8 is placed around the outside of the guide sleeve 9 (FIG. 3, FIG. 4). When the casing 8 is rotated to the position shown in FIG. 3, the fixing ring 17 cooperates with the sector stop 12 and serves to check upward shift of the curved casing 8 due to the pressing force of the springs 6 and 6'.

The cap 2 is secured to outer periphery of the cylindrical casing 8 and the lower end portion of the cap overlaps the upper end of the lower tubular casing 1 and is slidable relative thereto. The casing 8 is rotatable around the guide sleeve through about 180° relative to the guide sleeve 9, and when the mechanical pencil unit 3 is in the writing position, the casing 8 is shiftable within certain limits in the axial direction. The cap 2, being secured to the casing 8, is similarly rotatable through about 180° relative to the lower tubular casing 1, and then the pencil unit 3 is in the writing position, it is also shiftable within certain limits in the axial direction as will be described hereinafter.

Figure 8:
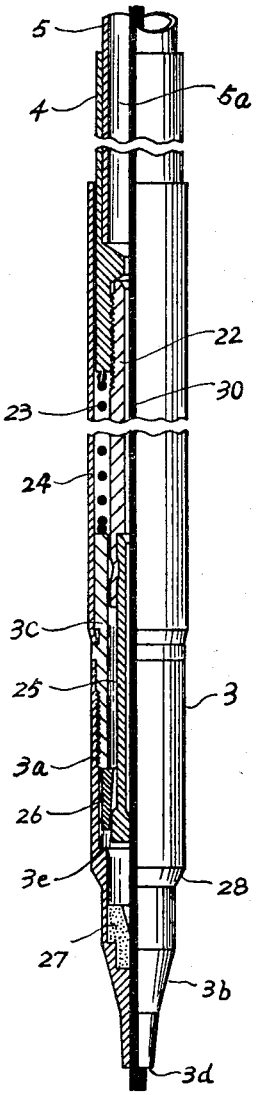
FIG. 8 is a partly broken away front view, showing the structure of the mechanical pencil unit.

The mechanical pencil unit 3 has a chunk mechanism portion, which is shown in FIG. 8. The rod 5 serves also as a magazine for the lead 30. The connecting sleeve is fixed on the lower outside of the rod 5, and on the lower inside of the sleeve 4 is secured an intermediate sleeve 22 to which sleeve 22 a split pawl chuck 25 is secured. On the tip portion of pencil body casing 3a is formed a pencil tip mouth piece 3b. To the upper portion of said casing 3a is connected a connecting tube 3c, and between the upper end of the tube 3c and the lower end of the connecting sleeve 4 is a spring 23. A cover casing 24 covers the connecting sleeve 4 and the connecting tube 3c, and constitutes a part of the pencil body casing 3a. In a space between the lower end of the connecting tube 3c and an abutting stepped portion 3e is a clamping sleeve 26 which cooperates with the chuck 25 slidably inserted therein and the interior of the sleeve 26 is tapered so as to gradually enlarge toward the tip mouth piece 3b. 27 denotes a rubber-like elastic supporting ring inserted in the tip mouth piece 3b. On the upper portion of the tip mouth piece 3b is an abutting stop portion 28 to abut against inside of the tip mouth 29 when the pencil body 3 is shifted towards the tip mouth 29 of the lower tubular casing 1 for the purpose of feeding the lead. The mode of feeding the lead according to this chuck mechanism will be described hereinafter.

The manner of advancing and retracting the mechanical pencil unit and the ball point pen unit to the writing position or the storage position in the writing instrument according to this invention will now be explained.

Figure 10D:
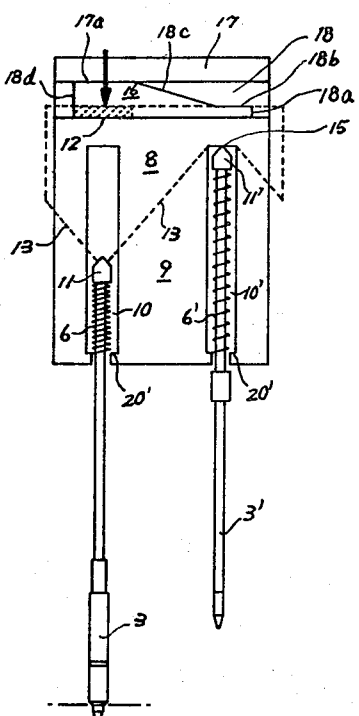
FIGS. 10(*a*), (*b*), (*c*) and (*d*) are developed explanatory views for explaining the movement of the mechanical pencil unit and the ball point pen unit to the writing position, the holding position and the lead feeding position with reference to the cam mechanism.
Figure 10C:
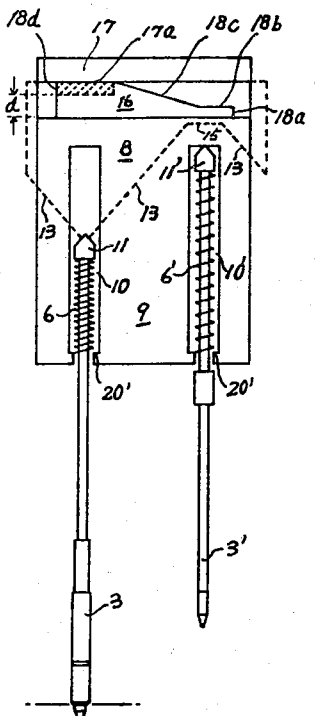
Figure 10B:
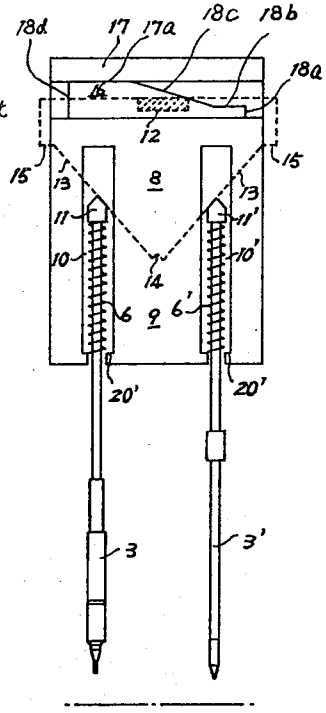

FIG. 10(b) shows the state in which both of the writing units 3 and 3' are in a storage position (neutral position). In this state, the slanting faces of the pointed engaging portions 11 and 11' at the tips of the rods 5 and 5' guided within the guide grooves 10 and 10' of the guide sleeve 9 respectively resiliently abut at about middle portion of sliding slanted faces 13 and 13 of the casing 8 due to the action of the springs 6 and 6'. Moreover, at this moment, the sector stop 12 at the top portion of the casing 8 abuts against the slanting face 18c of the cam 18 of the shaft head 16. The chain line shown below the writing units 3 and 3' denotes the position of the tip mouth 29 of the lower tubular casing 1.

Figure 10A:
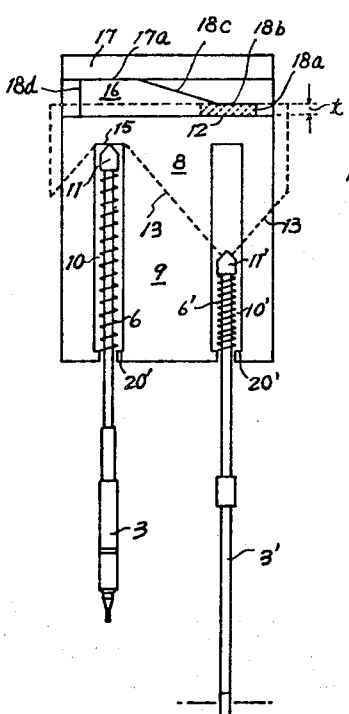

First, in order to advance the ball point pen unit 3' to the writing position, the cap 2 and with it the casing 8 secured thereto is rotated to the position shown in FIG. 10(a). Upon this rotation, the slanting face of the pointed engaging portion 11 on the mechanical pencil unit 3 is caused to slide along the sliding slanted face 13 of the casing 8 until the pointed engaging portion 11 reaches upper end of the guide groove 10 stopped there, at this time, by the flat portion 15 located at the upper portion of the upper end of the guide groove 10.

On the other hand, the printed engaging portion 11' on the ball point pen unit 3' is caused to slide downwardly along the other slanted face 13 of the casing 8 until it reaches the apex of said face and is engaged in the notched engaging portion 14. At this time, the sector stop 12 on the casing 8 fits in the clearance t formed between the lowermost flat face 18b of the cam 18 and the top face of the guide sleeve 9, and abuts against the stop 18a. Thus, the casing 8 is shifted slightly lower than the position of FIG. 10(b). Due to the fact that the stop 12 fits in said clearance t, the casing 8 is blocked against shifting in the axial direction relative to the guide sleeve 9. In the state of FIG. 10(a), the ball point pen unit 3 has been moved to the writing position.

Next, in order to advance the mechanical pencil unit 3, the cap 2 and with it the casing 8 is rotated to the position shown in FIG. 10(c) rotation through 180° from the position of FIG. 10(a) and through 90° from the position of FIG. 10 (b) ). Upon this rotation, the slanted face of the pointed engaging portion 11 of the mechanical pencil unit 3 is caused to slide downwardly along the slanted face 13 until it reaches the apex of the slanted face and is engaged in the notched engaging portion 14 and stopped there. Thus the mechanical pencil unit 3 is brought to the writing position. On the other hand, the sector stop 12 slides upwardly on the slanted face 18c of the cam 18, after slipping out of the clearance t, to the surface 17a and also abuts the stop 18d and is released from engagement with the cam 18.

However, as shown in FIG. 3, since it abuts the lower face of the fixing ring 17 on the shaft head 16, upward escape of the guide sleeve 9 due to the force of the springs 6 and 6' will be prevented. As a result of the sector stop 12 being brought to said position, the position of the casing 8 relative to the guide sleeve 9 is shifted upwardly corresponding to the shift of the sector stop 12.

As described above, in the state of FIG. 10(*c*), the sector stop 12 is at a position 17*a* spaced from the slanted face 18*c* of the cam 18 and abuts against the fixing ring 17 due to the force of the springs 6 and 6', and by pushing down the casing 8 by a force on the cap 2 in axial direction, it can be shifted to the position shown in FIG. 10(*d*) without encountering any obstruction. By the shift of the casing 8 in the axial direction, the mechanical pencil unit 3 is also shifted in axial direction. In this invention, in the state of FIG. 10(*c*), the distance between lower face of the sector stop 12 and top face of the guide sleeve 9, namely, the distance d (FIG. 10(*c*) ) in the axial direction of the sector stop 12 is made such that shifting of the pencil unit 3 by the axial shift of the casing 8 produces a feeding operation of the lead due to abutment of the abutting stop portion 28 against the tip mouth 29 of the lower tubular casing 1. Thus, when the casing 8 is pushed in axial direction by a force on the cap 2 and released, it is shifted reciprocatingly, so that the feeding operation of the lead of mechanical pencil unit is smoothly and surely effected, resulting in a state of writing being possible.

The feeding of the lead 30 of the mechanical pencil unit 3 will be explained with reference to FIG. 8.

When the mechanical pencil unit 3 is brought to a writing position as shown in FIG. 10(*c*), and the lower tubular casing is fixed, then the cap 2, i.e. the curved casing 8 is shifted by pushing it in the direction of arrow in FIG. 10(*d*), the mechanical pencil unit 3 is further shifted downwardly, as shown in FIG. 10(*d*), so that the abutting stop portion 28 of the mechanical pencil unit 3 abuts against the mouth 29 of the lower tubular casing 1. When the casing 8 is thus shifted downwardly, the connecting sleeve 4 connected with the rod 5 slides toward the tip of the mechanical pencil unit relative to the cover casing 24 against the action of the spring 23, because the abutting stop 28 abuts against the mouth 29. With the sliding of the connecting sleeve 4, the intermediate shift sleeve 22 and the split pawl chuck 25 connected thereto are shifted toward the tip of the mechanical pencil unit, whereupon the lead 30, which is held by the cooperation of the split pawl chuck 25 and a clamp sleeve 26, is fed toward the tip of the mechanical pencil unit. But, when the split pawl chuck 24 is further advanced toward the tip of the mechanical pencil unit, the clamp sleeve 26 being shifted with said chuck abuts against step 3*e* and the shift of said sleeve is stopped, so that said chuck 25 separates from the clamp sleeve 26 and the lead 30 is released from the holding force of the chuck 25. Thus, the lead 30 is fed a distance corresponding to the shift distance of the clamp sleeve 26. Next, when the force on the cap 2 and thus on the casing 8 is released, with the lead 30 being held by an elastic holding ring 27, the chuck 25, the intermediate shift sleeve 22, the connecting sleeve 4 and the rod 5 are restored to the original positions, and the chuck 25 will tightly hold the lead 30 again. By repeating the reciprocating shift due to the pushing of the cap 2, the lead 30 can be fed from the mouth 3*d* of the tip mouth piece 3*b* by an amount to enable writing. Spare leads may be stored in a cavity 5*a* in the rod 5, and these spare leads may be continuously fed in succession after the lead 30. Supply of the spare leads into the cavity 5*a* can be effected by making the connecting sleeve 4 detachable to the rod 5.

Further, the fed out lead may be returned to the original position, by pushing the lead into the tip mouth piece when the cap 2 has been shifted in the direction of arrow, namely in a condition with the chuck 25 released.

As described above, according to this invention, the mechanical pencil unit and the ball point pen unit may be smoothly and surely brought to a writing position and a storage position alternatively by rotating the cap and when the mechanical pencil unit is in the writing position, by shifting the cap in the axial direction, a lead feeding operation can be effected, whereby a composite writing instrument having a very simple structure and excellent durability is provided.

What is claimed is:

1. A composite writing instrument comprising:

a power tubular casing having a front end opening and an open rear end;

a guide sleeve inserted into the open rear end of said lower tubular casing, said guide sleeve having two diametrically opposite axially extending guide grooves therein and having a head member at the top;

a mechanical pencil unit and a ball point pen unit within said lower tubular casing with the writing tips towards the front end opening of said lower tubular casing and each having a slider on the rear end portion thereof resiliently slidably guided in a corresponding one of said guide grooves, said mechanical pencil unit having an axially movable portion connected to said slider and reciprocally movable for feeding lead out of the front end of said mechanical pencil unit;

a cylindrical casing member around said guide sleeve and rotatable around said guide sleeve through about 180°, said casing member having a cam surface thereon engaged with said sliders for moving one of said sliders downwardly for moving one unit forwardly out of the lower tubular casing when said casing member is rotated in one direction and moving the other slider downwardly for moving the other unit forwardly out of the lower tubular casing when said casing member is rotated in the other direction;

an upper tubular casing fixed on and covering said cylindrical casing member and covering the upper end portion of said lower tubular casing;

one of said members having cam means thereon and the other member having a cam follower thereon engaging with said cam means, said cam means and said cam follower being shaped for locking said casing member in a fixed axial position when said casing member is rotated in a direction for moving said ball point pen unit out of said lower tubular casing and for freeing said casing member for limited axial movement for moving the slider on said mechanical pencil unit for axially moving said portion of said mechanical pencil unit a sufficient distance to feed lead when said casing member is rotated in the direction for moving said mechanical pencil unit out of said lower tubular casing.

2. A composite writing instrument as claimed in claim 1 in which said cam means is on said head member and extends peripherally thereof, and said cam follower is on the inner radial face of said cylindrical casing member, said cam means extending about 180° around said head member and having stops at both ends thereof corresponding to the end positions of rotation of said casing member relative to said guide sleeve for limiting the rotation of said casing member to about 180°, said cam means defining a gap with an axial dimension substantially the same as the axial dimension of said cam follower at the end toward which said cam follower moves when said casing member is rotated for urging said ball point pen unit out of said lower tubular casing, whereby axial movement of said casing member relative to said guide sleeve is prevented, and defining at the other end a space having an axial dimension substantially equal to the distance said axially movable portion of said mechanical pencil unit moves to feed lead therefrom for permitting movement of said cylindrical casing member relative to said guide sleeve when said cylindrical casing is rotated for urging said mechanical pencil unit out of said lower tubular casing.

* * * * *